United States Patent [19]

Grappe

[11] Patent Number: 4,767,356

[45] Date of Patent: Aug. 30, 1988

[54] ELECTRICAL CONNECTORS, PARTICULARLY CONNECTORS FLUID-TIGHT ON IMMERSION IN A LIQUID

[75] Inventor: René Grappe, Paris, France

[73] Assignee: Souriau & Cie, Boulogne Billancourt, France

[21] Appl. No.: 926,109

[22] Filed: Nov. 3, 1986

[30] Foreign Application Priority Data

Nov. 8, 1985 [FR] France ..... 85 16573

[51] Int. Cl.[4] ..... H01R 13/58

[52] U.S. Cl. ..... 439/455; 439/279; 439/282; 439/465

[58] Field of Search ..... 339/208, 210 R, 210 M, 339/211, 103, 104, 105, 107, 196 R, 196 M, 276 R, 94, 60, 213 R

[56] References Cited

U.S. PATENT DOCUMENTS

| | | | |
|---|---|---|---|
| 2,450,271 | 9/1948 | Dann | 339/103 M |
| 3,054,847 | 9/1962 | Colbert | 339/213 R |
| 3,316,523 | 4/1967 | Trangmar | 339/107 |
| 3,390,371 | 6/1968 | Kramer | 339/107 |
| 3,856,376 | 12/1974 | Poliak et al. | 339/107 |
| 3,986,765 | 10/1976 | Shaffer et al. | 339/103 R |
| 4,310,213 | 1/1982 | Fetterolf et al. | 339/103 M |

*Primary Examiner*—David Pirlot

*Attorney, Agent, or Firm*—Larson and Taylor

[57] ABSTRACT

An electrical connector comprises two mechanically couplable elements to cause electrical contacts positioned in these elements, to cooperate in pairs. At least one of the elements comprises an insulating body pierced with longitudinal housings shielding the contacts and itself retained and shielded, at least in part, in an outer casing. Clamping means for the element to a cable joined electrically to the contacts comprise: a collar engirdling the outer sheath of the cable and two diametrically opposite radial projections. Two half-clamps surround the rear end of the insulating body and the neighboring zone of the cable including the collar, each projection being engaged in two respective inner recesses of the two half-clamps. Axial connecting means and means for fastening in rotation are provided between the insulating body and the half-clamps as well as assembly means for the half-clamps.

10 Claims, 2 Drawing Sheets

Figure 2:
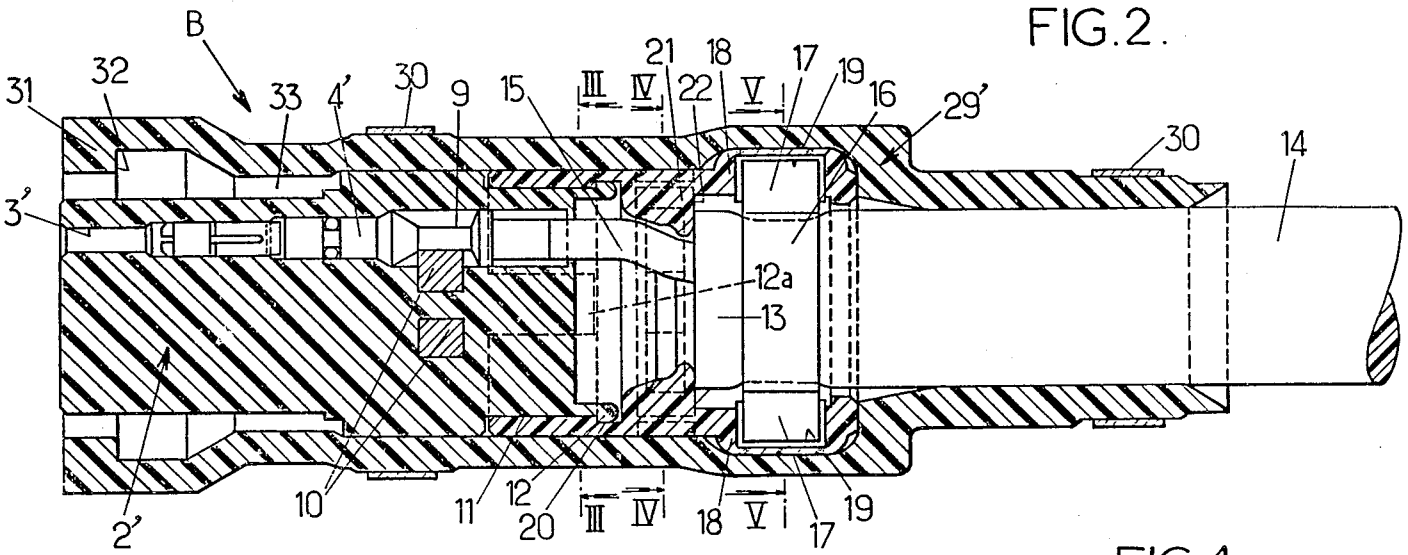

14
30
29'
16
19
17
V
18
22
21
IV
III
15
9
30
4'
33
B
32
31
3'
2'
10
11
20
12
12a
13

6
5
7
8
4
9
3
11
12
20
III
IV
21
18
V
17
19
16
29
A
30
14
2
10
15
22
13
12a

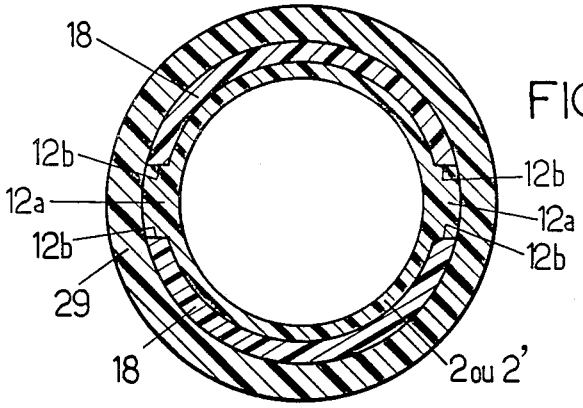
FIG. 3.
FIG. 4.
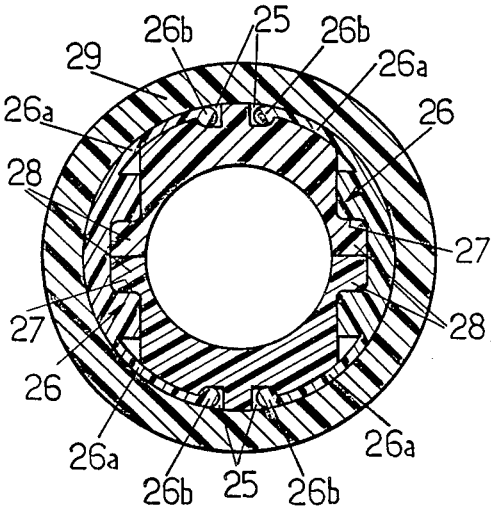
FIG. 5.
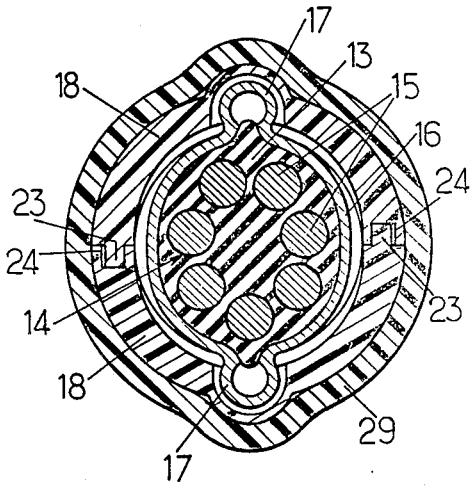

ELECTRICAL CONNECTORS, PARTICULARLY CONNECTORS FLUID-TIGHT ON IMMERSION IN A LIQUID

The present invention relates to improvements in or to electrical connectors, particularly connectors which are fluid-tight on immersion in a liquid, comprising two connector elements which can be mechanically coupled to one another, to effect the mechanical and electrical cooperation in pairs of the electrical contacts positioned respectively in said elements, one at least of the connector elements comprising an insulating body which is pierced by longitudinal housings shielding the contacts respectively and which is itself retained and shielded, at least in part, in an outer casing, means for clamping the connector element onto an electrical cable connected electrically to the contacts being also provided.

It is an essential object of the invention to provide an electrical connector of the above type which gives better satisfaction than those hitherto known, in particular to provide an electrical connector which is protected against a corrosive environment (in particular sea water) and under pressure (immersion at great depth) and which is arranged, from a structural point of view, so that a traction exerted on a cable is manifested by a non-destructive separation of the two connector elements (so-called "fusible" connector) and not by tearing away of the cable.

For these purposes, an electrical connector arranged according to the invention is characterized in that the above said clamping means comprise:

at least one collar engirdling the outer sheath of the cable, said collar having at least two diametrically or approximately diametrically opposite radial projections, at least two half-clamps surrounding the rear end of the insulating body and the neighboring zone of the cable, including here the collar engirdling the latter, each projection of the collar being engaged in respective inner recesses of the two half-clamp, axial connecting means and means for making fast in rotation are provided between the insulating body and the half-clamps, and assembly means associated with the two half-clamps to hold the latter assembled one against the other.

Advantageously, the projections of the collar are constituted by ears formed by the collar.

Desirably, along their mutual supporting edge, the half-clamps have complementary positioning and transverse locking relief elements.

Preferably, to constitute the axial coupling means between the insulating body and the half-clamps, the insulating body comprises a radially projecting beading located in the rear portion of the outer surface thereof, and the half-clamps comprise an inner annular groove located in their portion surrounding the rear part of the insulating body, the inner annular groove adapted to cooperate by fitting together with the above-said beading.

Advantageously, along at least one portion of their mutual supporting edge, the half-clamps have a rim projecting outwards and the assembly means comprise clips which straddle the half-clamps and which, in their zone situated facing the abutted edges of the half-clamps, possess each a channel engirdling the two abutted edges of the two half-clamps.

In order to simplify the construction and to avoid the use of conventional assembly members such as screws or the like, the clips are provided with elastically deformable arms enveloping the two half-clamps and whose ends are elastically clipped into retaining cavities hollowed in the outer surface of the two half-clamps.

Preferably, the casing is constituted by a sleeve of a semi-rigid material, possessing elastic deformation properties, and this sleeve elastically engirdles a rear portion of the insulating body, the clamping means and a portion of the cable; in the case of immersion under high pressure, additional collars engirdle the casing around the insulating body and around the cable.

By means of the features according to the invention, a connector is obtained which fully withstands corrosive media since all the relatively vulnerable constituant members (such as electrical contacts and bared ends of the conductors), including here the metal collar engirdling the sheath of the cable, are protected in fluid-tight manner by the outer protective casing; this connector supports high pressures, and can hence be immersed to great depth, due to the fact that the fluid-tightness of the deformable casing (as the case may require, reinforced by additional collars) is all the more increased as the pressure is higher; finally any traction applied to the cable is transmitted, not by the electrical conductors, but by the mechanical "bridge" constituted by the collar fastened to the half-clamps themselves fastened to the insulating body: in the case of too great a traction an uncoupling of the two connector elements will result therefrom, and not tearing off away from the electrical conductors which are not subjected to any force.

Finally, it will be noted that the constitution of such a connector is very simple, that the number of constituent parts is reduced, that their assembly is effected solely by clipping without any applied coupling member (such as screws or the like); and as a result there is greater reliability in the course of use.

Figure 1:
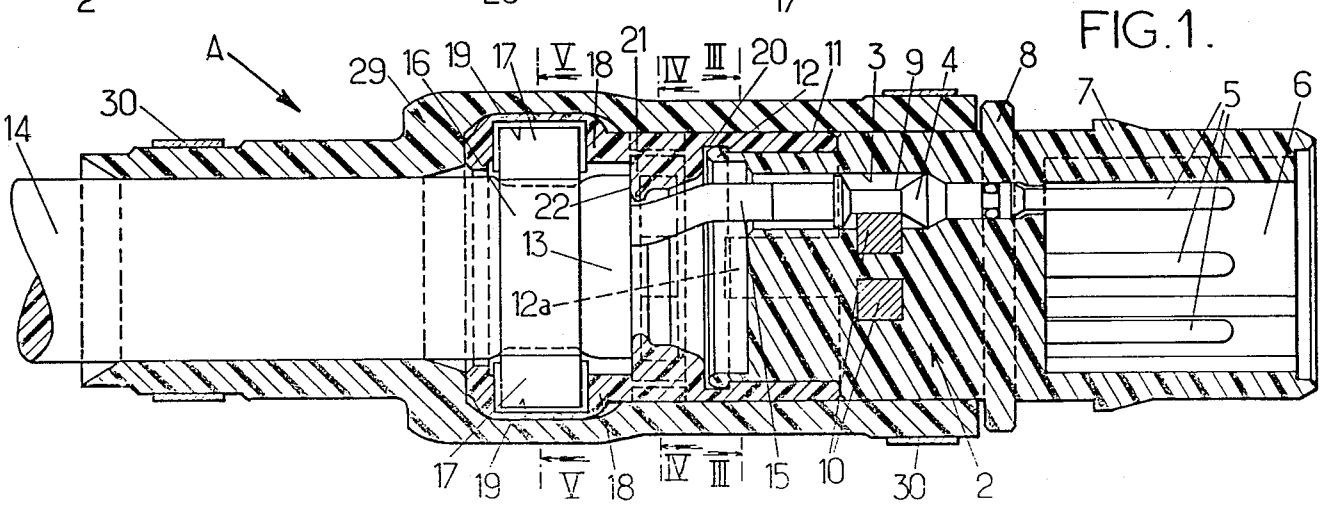

The invention will be better understood on reading the description which follows of a prefered embodiment, given only by way of purely illustrative example. In this description, reference is made to the accompanying drawings in which:

FIGS. 1 and 2 are views in diametric section respectively of two connector elements arranged according to the invention and which can be coupled to one another, and FIGS. 3 to 5 are cross-sectional views, respectively along the lines III—III, IV—IV and V—V of FIG. 1 or 2.

Referring first to FIG. 1, the connector element A which is shown therein comprises an insulating body 2 provided with longitudinal housings 3 in which are shielded and held electrical contacts 4, which here are of the male type with active ends in pin form 5.

At its front end (that is to say that turned towards the other element of the connector with which the element A is couplable), the insulating body 2 is hollowed to form a chamber 6, open forwardly, in which are shielded the pins 5. On the outer surface, the insulating body shows, in the vicinity of its front end, an annular projection 7 conformed with an inclined front radial surface to form a ramp and with a rear radial surface constituting a retaining shoulder. Behind the annular projection 7 is provided an annular stop 8.

Each contact 4 has an annular narrowed portion 9. One or several pins 10 are engaged in the insulating body 2 transversely to the contacts 4, so as to cooperate with the annular narrowed portion 9 of the contacts and to prevent any longitudinal movement of the latter.

For fuller details of a connector thus arranged, reference may be made to patent application FR No. 83 20904 published under No. 2 557 740.

In its rear portion, the insulating body 2 has a zone 11 of smaller diameter possessing a radial annular beading 12 projecting outwardly. In addition, at this level are provided two diametrically opposite key elements, 12*a*, projecting radially.

Around the end of the sheath 13 of a cable 14, whose conductors 15 are joined (for example welded) to the tails of the contacts 4, is gripped a metal collar 16. The collar 16 possesses two diametrically opposite ears 17: these ears open before the assembly of the collar on the cable are gripped by pincers and deformed into a Ω, as better seen in FIG. 5, to cause the clamping of the collar onto the cable 14.

Two half-clamps 18, forming two half-shells, are joined to surround the rear zone 11 of the insulating body 2 and the portion of the cable gripped by the collar 16. In its front portion, each half-clamp 18 has a recess 12*b* which cooperates with the above-mentioned key element 12*a* of the insulating body 2, so as to ensure the making fast in rotation of the two half-clamps 18 and of the insulating body 2. Internally, each half-clamp 18 comprises a recess 19 adapted to receive one of the ears 17 of the collar 16, as well as an annular groove 20 arranged to receive the beading 12; in addition, there may be provided an inner protuberance 21 shaped rearwards to constitute a radial stop 22 against which the front end of the sheath 13 of the cable 14 is supported. The construction of two half-clamps 18 is seen better in FIGS. 4 and 5.

On their mutual supporting edge, the two half-clamps 18 possess a tenon 23 and groove 24 fitment system (FIG. 5), ensuring their correct mutual transverse maintenance. In order that the two upper and lower half-clamps should not be differentiated, each tenon 23 and each groove 24 only extends over a half-perimeter, the other half-perimeter being equipped inversely (respectively groove and tenon).

In addition, as seen in FIG. 4, to hold the assembly of the two half-clamps 18, there are provided two clips 26 each of which has a channel 27 engirdling two coupled projecting rims 28, belonging respectively to the two half-clamps and situated in the vicinity of the mutual support edges of the latter. Each clip 26 is held in straddling position on the two half-clamps by means of two elastically deformable arms 26*a* which respectively partially engirdle the two half-clamps and whose ends in the form of a retaining pin 26*b* are elastically clipped in retaining grooves 25 hollowed in the outer surface of the two half-clamps and offset angularly by approximately 90° with respect to the above-said rims 28.

Due to such an arrangement, the cable 14 is rendered mechanically fast axially, with the insulating body 2, through half-clamps 18 and the collar 16, without the conductors 15 being subjected to any mechanical force.

The assembly which has just been described is surrounded by a casing 29 constituted by a sleeve of a material such an elastomer, having a relative elasticity and molded into shape to mate elastically internally the contour of the connector: this sleeve closely engirdles the cable 14, the half-clamps 18 and the insulating body 2 behind the annular stop 8. In the case where the connector must be subjected to considerable pressure, it is possible to provide two outer supplementary collars 30, arranged around the casing 29, respectively around the cable 14 at the rear and around the insulating body 2 at the front.

Due to the elastic gripping procured by the casing 29, as the case may require, reinforced by the gripping action of the outer collars 30, the fluid-tightness of the connector element is ensured.

FIG. 2 shows, in the same way, an element B of an electrical connector, arranged on the same principle as the element A described previously and coupleable with the latter. Hence the same reference numerals will be used to denote the memebers of the element B identical with those of the element A. A' will be attributed to the numerical references of the members of the element B which correspond, in a structurally different form, to the organs of the element A.

The insulating body 2' of the element B contains female contacts 4', of the bush type which are completely shielded in the respective housings 3'.

The front end of the insulating body 2' has a reduced diameter, corresponding to the inner diameter of the chamber 6 so as to penetrate into the latter in the course of coupling the two elements A and B.

In addition, the casing 29' extends forwards to the height of the front surface of the insulating body 2'. In its front part, the casing 29' does not mate the contour of the insulating body 2', but is on the contrary shaped to remain at a radial distance from the latter by defining an annular cavity 33 designed to receive the front annular portion, defining the chamber 6, of the insulating body 2 of the element A.

The front end of the casing 29' has a radial rim 31 directed inwardly and bounds a supporting shoulder 32 adapted, during the coupling of the two elements A and B to cooperate with the retaining shoulder formed by the rear radial surface of the annular projection 7.

For the rest, the element B is shaped exactly like the element A, in particular as regards the features according to the invention.

In the course of the coupling of the two elements A and B, the rear rim 31 of the casing 29' of the element B is engaged between the annular stop 8 and the annular projection 7 of the insulating body 2 of the element B. Fluid-tightness is ensured by the rim 31 which grips elastically the annular surface of the insulating body 2 comprised between the stop 8 and the projection 7 at the same time as the portion of the casing 29' situated behind the rim 31 which grips elastically the outer surface of the insulating body situated in front of the projection 7.

As is self-evident and as emerges already besides from the foregoing, the invention is in no way limited to those of its types of application and embodiments which have been more particularly envisaged; it encompasses, on the contrary, all modifications thereof.

I claim:

1. An electrical connector, particularly a fluid-tight connector on immersion in a liquid, comprising two elongate connector elements each having respective electrical contacts at a forward end thereof, said connector elements coupleable mechanically with one another, to cause the mechanical and electrical cooperation in pairs of said electrical contacts, at least one of the connector elements comprising an insulating body which is pierced by longitudinal housings shielding the contacts respectively and which is itself retained and shielded, at least in part, in an outer casing, clamping means for clamping the rear end of the connector element to an electrical cable having an outer sheath and joined electrically to the contacts being provided in addition, characterized in that said clamping means comprise:

at least one collar gripping the outer sheath of the cable, said collar having at least two radial diametrically or approximately diametrically opposite radial projections, at least two half-clamps having an outer surface and engirdling the rear end of the insulating body and a neighboring zone of the cable, including here the collar gripping the cable, each projection of the collar being engaged in two respective inner recesses of the two half-clamps, said recesses and said collar projections being so shaped and dimensioned that the collar projections are closely surrounded by the recess walls so that the collar and the half-clamps, and consequently also the insulating body, are mutually interlocked axially and in rotation, wherein said half-clamps have respective, mutual abutting supporting edges and, along at least a portion of their mutual supporting edge, the half-clamps have a rim projecting outwardly, and assembly means associated with the two half-clamps to maintain the latter assembled one against the other and said assembly means comprising clips which straddle the half-clamps and which, in a corresponding zone thereof that is situated facing the rims abutting the half-clamps, each clip possesses a channel gripping the two abutted rims of the two half-clamps.

2. An electrical connector according to claim 1, characterized in that the projections of the collar are constituted by ears formed by the collar.

3. An electrical connector according to claim 1, characterized in that said half-clamps have respective, mutual abutting supporting edges, and have along their mutual supporting edge, complementary positioning and transverse blocking relief elements.

4. An electrical connector according to claim 1, characterized in that, so as to complete the axial interlocking between the insulating body and the half-clamps, the insulating body is generally cylindrical having an outer surface and comprising, in a rear part of its outer surface, a beading projecting radially, and the half-clamps engirdling the rear end of the insulating body, comprising an inner annular groove adapted to cooperate by assembly with said beading.

5. An electrical connector according to claim 1, characterized in that the clips are generally arcuate in shape and are provided with elastically deformable arms having respective ends and enveloping the half-clamps and of which the arm ends are elastically clipped in retaining cavities hollowed in the outer surface of the half-clamps.

6. An electrical connector, particularly a fluid-tight connector on immersion in a liquid, comprising two elongate connector elements each having respective electrical contacts at a forward end thereof, said connector elements coupleable mechanically with one another, to cause the mechanical and electrical cooperation in pairs of said electrical contacts, at least one of the connector elements comprising an insulating body which is pierced by longitudinal housings shielding the contacts respectively and which is itself retained and shielded, at least in part, in an outer casing, clamping means for clamping the rear end of the connector element to an electrical cable having an outer sheath and joined electrically to the contacts being provided in addition, characterized in that said clamping means comprise:

at least one collar gripping the outer sheath of the cable, said collar having at least two radial diametrically or approximately diametrically opposite radial projections, at least two half-clamps having an outer surface and engirdling the rear end of the insulating body and a neighboring zone of the cable, including here the collar gripping the cable, each projection of the collar being engaged in two respective inner recesses of the two half-clamps, said recesses and said collar projections being so shaped and dimensioned that the collar projections are closely surrounded by the recess walls so that the collar and the half-clamps, and consequently also the insulating body, are mutually interlocked axially and in rotation, said casing being constituted by a sleeve of a semi-rigid material, possessing properties of elastic deformation, and this sleeve elastically grips a rear portion of the insulating body, the clamping means and a portion of the cable, and assembly means associated with the two half-clamps to maintain the latter assembled one against the other.

7. An electrical connector according to claim 6, characterized in that, in the case of immersion under high pressure, auxiliary collars engirdle the casing, around the insulating body and around the cable.

8. An electrical connector according to claim 6, characterized in that the projections of the collar are constituted by ears formed by the collar.

9. An electrical connector according to claim 6, characterized in that said half-clamps have respective, mutual abutting supporting edges, and have along their mutual supporting edge, complementary positioning and transverse blocking relief elements.

10. An electrical connector according to claim 6, characterized in that, so as to complete the axial interlocking between the insulating body and the half-clamps, the insulating body is generally cylindrical having an outer surface and comprising in a rear part of its outer surface, a beading projecting radially, and the half-clamps engirdling the rear end of the insulating body, comprising an inner annular groove adapted to cooperate by assembly with said beading.

* * * * *